US006904632B1

(12) United States Patent
Wu

(10) Patent No.: US 6,904,632 B1
(45) Date of Patent: Jun. 14, 2005

(54) ELASTIC CUSHION

(76) Inventor: Ching-Hsun Wu, No. 499, Sec. 2, Chungshan Rd., Wuri Hsiang, Taichung Hsien (TW)

( * ) Notice: Subject to any disclaimer, the term of this patent is extended or adjusted under 35 U.S.C. 154(b) by 0 days.

(21) Appl. No.: 10/721,858

(22) Filed: Nov. 26, 2003

(51) Int. Cl.[7] ..... A47C 7/02

(52) U.S. Cl. ..... 5/630; 5/948

(58) Field of Search ..... 5/630, 652, 948

(56) References Cited

U.S. PATENT DOCUMENTS 5,683,811 A * 11/1997 Hernandez et al. ..... 428/373
5,788,332 A * 8/1998 Hettinga ..... 297/452.55

* cited by examiner

*Primary Examiner*—Heather Shackelford
*Assistant Examiner*—Fredrick Conley
(74) *Attorney, Agent, or Firm*—Rosenberg, Klein & Lee

(57) ABSTRACT

An elastic cushion has a cover and an elastic body received inside the cover. The elastic body is made of multiple elastic folded tubes and has multiple gaps inside. Because the gaps are formed inside the elastic body, air can easily pass through the elastic cushion, and the elastic cushion can provide a non-sticky sitting feeling to a user.

3 Claims, 3 Drawing Sheets

ELASTIC CUSHION

BACKGROUND OF THE INVENTION

1. Field of Invention

The present invention relates to a cushion, and more particularly to an elastic cushion that can easily let air through.

2. Description of the Related Art

With reference to FIG. 5, a conventional cushion has a cover (60) and a soft stuffing inside. When a user sits on the conventional cushion, it can provide a comfortable feeling and a buffering effect. The soft stuffing can be made of foam (65). However, using the foam (65) as the soft filling has the following disadvantages:

1. Although the foam (65) has many small chambers formed inside, those small chambers are too small and do not easily let air through. When sitting on the conventional cushion with the foam (65) inside, a user soon feels a stickiness between the buttocks and the cushion because of the lack of through-flow air.

2. The foam (65) can not provide a long useful life, because it is easily oxidized by the air and becomes brittle after long term use.

Because of the above disadvantages of the conventional cushion in FIG. 5, another type of cushion has been designed. With reference to FIG. 6, another type of cushion has the cover (60), two resin bodies (70) and a plant cellulose layer (75). The resin bodies (70) are received inside the cover (60) and the plant cellulose layer (75) is mounted between the resin bodies (70). However, the sticky feeling a user feels is still not solved.

To overcome the shortcomings, cushions that can provide long-term comfort is still needed, and a cushion in accordance with the present invention obviates or mitigates the aforementioned problems.

SUMMARY OF THE INVENTION

The primary objective of the present invention is to provide an elastic cushion that has a cover and an elastic body received inside the cover. The elastic body is made of multiple elastic folded tubes and has multiple gaps inside. Because of the gaps formed inside the elastic body, air can easily pass through the cushion, and the elastic cushion can provide a non-sticky sitting feeling to a user.

Other objectives, advantages and novel features of the invention will become more apparent from the following detailed description when taken in conjunction with the accompanying drawings.

DETAILED DESCRIPTION OF THE INVENTION

Figure 1:
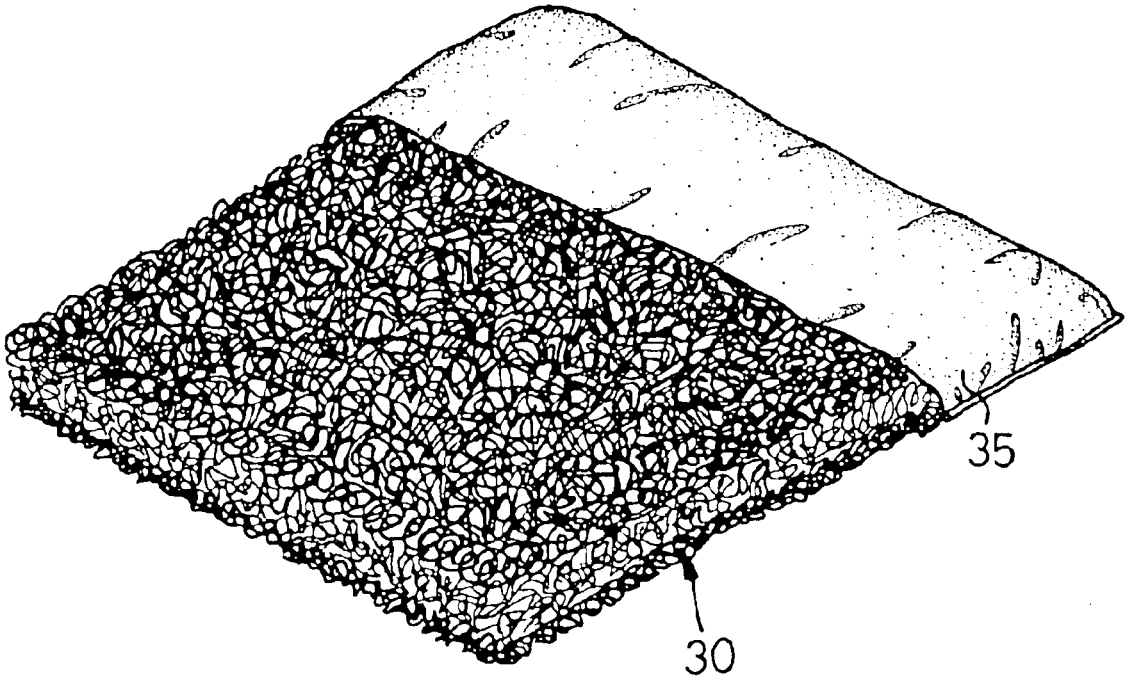
FIG. 1 is a perspective view of an elastic cushion with a partial cover in accordance with the present invention.
Figure 3:
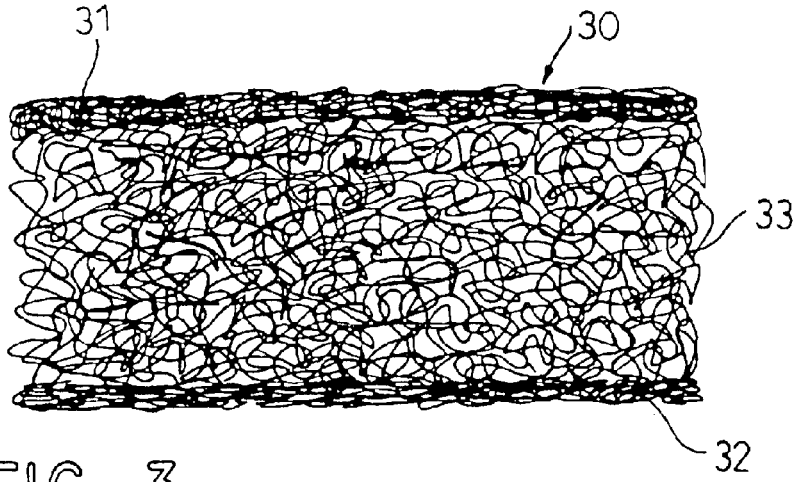
FIG. 3 is a side plan view of the elastic cushion in FIG. 1 with the cover removed.
Figure 2:
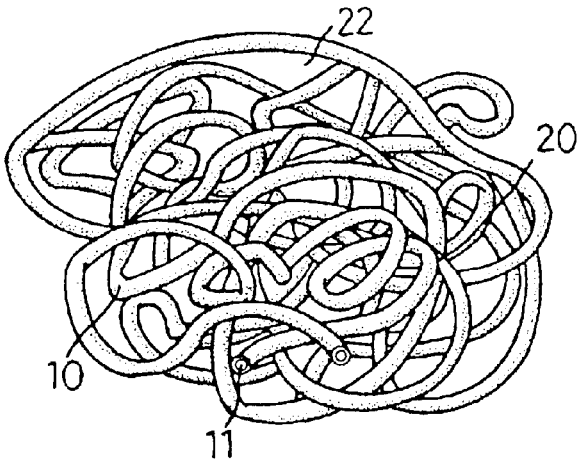
FIG. 2 is a perspective view of elastic tubes inside the cushion in FIG. 1.

With reference to FIG. 1 to FIG. 3, an elastic cushion in accordance with the present invention comprises a cover (35) and an elastic body (30).

The cover (35) may be made from cloth and has a cavity (not numbered) formed inside. The cover (35) is air permeable and easily lets air through.

The elastic body (30) is received inside the cover (30) and has a top surface (31), a rear surface (32), an inner portion (33) and multiple elastic tubes (10), such as plastic tubes. Each elastic tube (10) is made of a stable material that is not easily oxidized and has a hollow center (11) and folded points. The elastic tubes (10) are randomly folded to form a square, a cylinder, and so on. Such folded elastic tubes (10) provide a comfortable feeling when being sat on, so the folded elastic tubes (10) can be used as a soft stuffing inside the cushion. The folded tubes (10) are melted at the folded points, so that the elastic tubes (10) can be formed as many random weld portions (20) and gaps (22). The hollow centers (11) of the elastic tubes at the weld portion (20) communicate with each other. Furthermore, the top surface (31) and the rear surface (32) of the elastic body (30) may be folded by a high density of the elastic tubes (10), and the inner portion (33) of the elastic body (30) may be folded by a low density of the elastic tubes (10). Because the cover (35) easily lets air through and the elastic body (30) has many gaps (22), the cushion can allow air to enter and leave.

Figure 4:
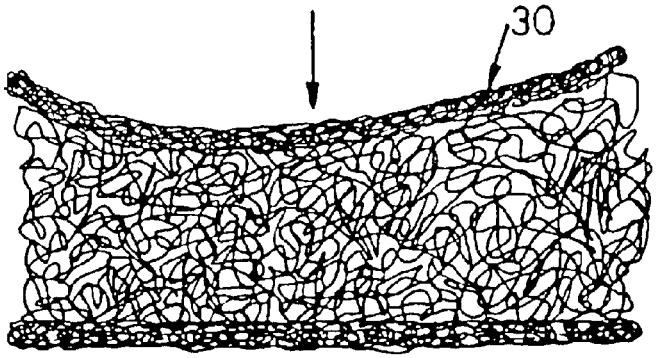
FIG. 4 is a side plan view of the elastic cushion with an arcuate top surface.
Figure 5:
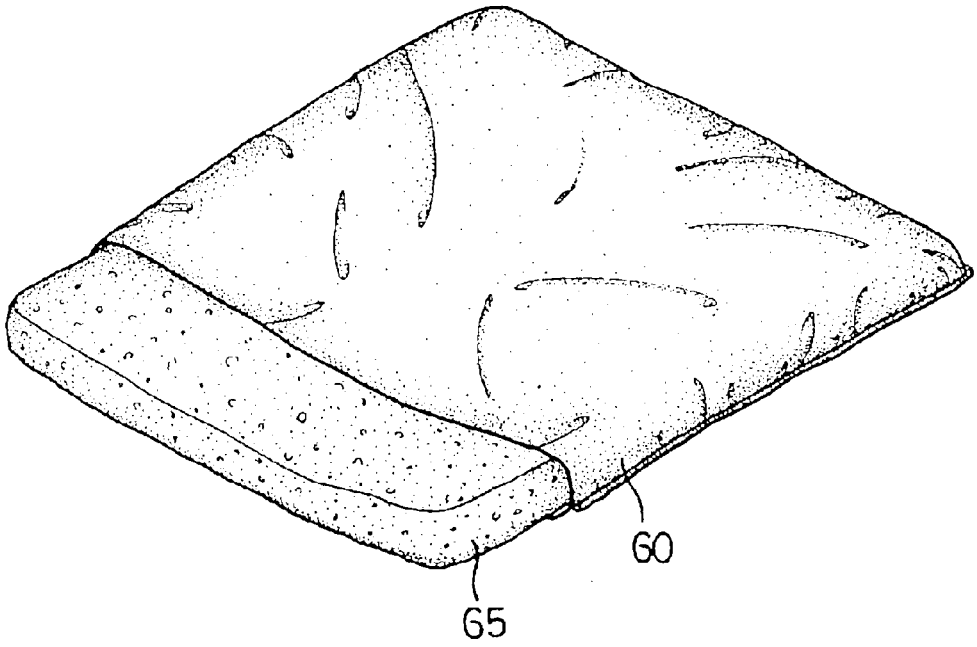
FIG. 5 is a perspective view of a conventional cushion in accordance with the prior art.
Figure 6:
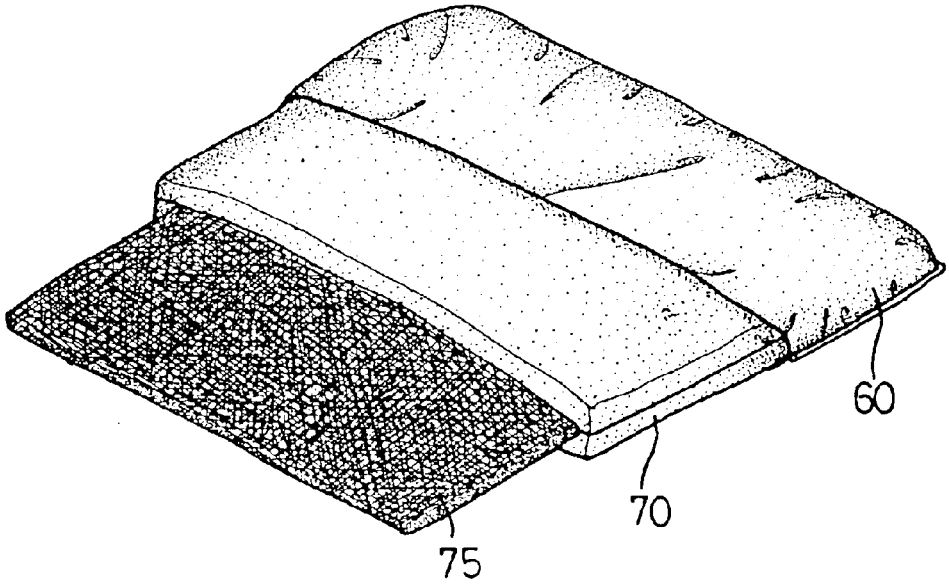
FIG. 6 is a perspective view of another conventional cushion in accordance with the prior art.

With reference to FIG. 4, to make the elastic cushion in accordance with the present invention a comfortable seat, the top surface of the elastic body (30) may be formed as an arcuate top surface.

The elastic cushion in accordance with the present invention has the following advantages:

1. The elastic body (30) is made of the elastic tubes (10) with hollow centers (11) and the gaps (22) inside the elastic body (30), so that the air can easily enter and leave the elastic body (30). When sitting on the elastic cushion with the elastic body (30) received inside the cover (30), a user will not feel sticky because of the free flow of air between the buttocks and the elastic cushion.

2. Because the elastic body (30) is made of the elastic tubes (10) and the material of the elastic tubes (10) is stable and not easily oxidized, the elastic cushion can provide a long useful life.

The invention may be varied in many ways by a person skilled in the art. Such variations are not to be regarded as a departure from the spirit and scope of the invention, and all such modifications are intended to be included within the scope of the following claims.

What is claimed is:

1. An elastic cushion comprising:

a cover having a cavity formed therein; and an elastic body formed of multiple elastic tubes received in the cavity of the cover and having a top surface portion, a rear surface portion, and an inner portion; the multiple elastic tubes being randomly folded together to form folded points, each elastic tube having a hollow center, the folded elastic tubes being formed as many random weld portions and gaps, the hollow centers of the welded elastic tubes being in open communication with each other, the elastic tubes of the top surface portion and rear surface portion of the elastic body are formed to have a first density, and the elastic tubes of the inner portion of the elastic body being formed to have a second density, the first density being higher than the second density.

2. The elastic cushion as claimed in claim 1, wherein the top surface of the elastic body is formed as an arcuate top surface.

3. The elastic cushion as claimed in claim 2, wherein the elastic tubes are plastic tubes.

* * * * *